US005813552A

United States Patent [19]

Kaspar

[11] Patent Number: 5,813,552

[45] **Date of Patent: *Sep. 29, 1998**

[54] TELESCOPIC BOOM WITH MULTISTAGE HYDRAULIC CYLINDER

[75] Inventor: Ernst Kaspar, Munderkingen, Germany

[73] Assignee: EC Engineering + Consulting Spezialmaschinen GmbH, Ulm, Germany

[ * ] Notice: The term of this patent shall not extend beyond the expiration date of Pat. No. 5,584,645.

[21] Appl. No.: 663,254

[22] PCT Filed: Dec. 5, 1994

[86] PCT No.: PCT/EP94/04043

§ 371 Date: Sep. 26, 1996

§ 102(e) Date: Sep. 26, 1996

[87] PCT Pub. No.: WO95/15911

PCT Pub. Date: Jun. 15, 1995

[30] Foreign Application Priority Data

Dec. 8, 1993 [DE] Germany ..... 96 18 847 U
May 19, 1994 [DE] Germany ..... 94 08 289 U

[51] Int. Cl.[6] ..... B66C 23/04

[52] U.S. Cl. ..... 212/349; 212/296

[58] Field of Search ..... 212/349, 350, 212/296, 230, 231; 52/118

[56] References Cited

U.S. PATENT DOCUMENTS

| | | | |
|---|---|---|---|
| 3,353,686 | 11/1967 | Cowan | 212/55 |
| 3,792,555 | 2/1974 | Sung | 212/349 |
| 3,836,011 | 9/1974 | Sakamoto et al. | 212/144 |
| 3,837,502 | 9/1974 | Hornagold | 212/55 |
| 4,358,915 | 11/1982 | Pantalone | 52/115 |
| 4,408,424 | 10/1983 | Sutter | 52/115 |
| 5,584,645 | 12/1996 | Kaspar | 414/728 |

FOREIGN PATENT DOCUMENTS

| | | | |
|---|---|---|---|
| 1122682 | 1/1962 | Germany . | |
| 1240743 | 5/1967 | Germany . | |
| 1756141 | 8/1970 | Germany . | |
| 1221197 | 3/1986 | U.S.S.R. | 212/349 |
| 1191395 | 5/1970 | United Kingdom . | |
| 1211036 | 11/1970 | United Kingdom . | |

*Primary Examiner*—Thomas J. Brahan
*Attorney, Agent, or Firm*—Rothwell, Figg, Ernst & Kurz, P.C.

[57] ABSTRACT

A telescopic boom contains a multistage hydraulic cylinder for extending and retracting the boom parts. The telescopic boom is characterized in that a first component of a supporting device is secured to at least one cylinder and in that a second component of the supporting device is secured to a least one telescopic boom part. The second component co-operates with the first component to support the hydraulic cylinder on the boom parts. The first component of the supporting device is shaped as two opposing claws and the second component is shaped as two opposing rails or rail sections. The claws grasp the rails or rail sections, and the rails or rail sections are provided on the inner wall part of the boom part.

12 Claims, 7 Drawing Sheets

TELESCOPIC BOOM WITH MULTISTAGE HYDRAULIC CYLINDER

For the purpose of extending and retracting telescopic booms, e.g. booms of cranes and excavators, telescopic, i.e. multistage, hydraulic cylinders are frequently used. Each subsection of the telescopic boom, i.e. each so-called telemember, has normally associated therewith one unit of the multistage telescopic hydraulic cylinder. During operation, the hydraulic cylinder is acted upon by bending forces, said bending forces increasing in proportion to the increase in the length of the hydraulic cylinder and resulting from the unloaded weight of the hydraulic cylinder as well as from the loads to be lifted. These bending forces may cause buckling of the hydraulic cylinder.

Up to now, attempts have been made to prevent such buckling by providing the cylinder walls with adequately strong dimensions. However, this strong dimensioning of the hydraulic cylinder walls results in an increase of the unloaded weight of the hydraulic cylinder, and this has the effect that the maximum load which can be lifted is reduced accordingly.

It is therefore the object of the present invention to construct a telescopic boom with a multistage hydraulic cylinder in such a way that, without a buckling-proof dimensioning of the hydraulic cylinder, buckling of the hydraulic cylinder need not be feared under any operating conditions.

This object is achieved by the invention disclosed in claim 1. The technical progress which can be achieved by means of the present invention results primarily from the fact that measures have been taken with the aid of which the hydraulic cylinder is supported throughout its whole length or through selected subsections thereof by the telemembers of the boom which are constructed as buckle-proof members from the very beginning. A particular advantage results from the fact that, thanks to the present invention, protection against buckling of the hydraulic cylinder exists not only in the final stages of the boom extension process but also in all intermediate stages and even during the transition from one stage of the boom extension process to the next one.

Another advantage of the present invention must be seen in the fact that the individual hydraulic cylinder units are prevented from rotating relative to one another, since the supporting means according to the present invention guarantee that a rotational displacement of individual hydraulic cylinder units relative to one another cannot occur.

The invention will be described in detail in the following on the basis of an embodiment and with reference to the drawing, in which.

According to FIG. 1, the telescopic boom as shown comprises a non-telescopic basic member GK as well as five telescopic members A to E, which will be referred to as telemembers hereinbelow. From the basic member GK up to telemember E, which is extended furthest and which has the smallest dimension as far as the diameter is concerned, the diameters and the base areas of the telemembers decrease in a manner known per se.

For extending the telemembers A to E from the basic member GK and for retracting them into said basic member GK, a hydraulic cylinder is provided, which comprises five telescopic cylinder units I to V in addition to a basic unit "O" arranged in the basic member GK of the boom. Cylinder unit I, which follows the basic unit "O", serves to extend and retract telemember A; cylinder unit II, which follows said cylinder unit I, serves to extend and retract telemember B; cylinder unit III, which follows said cylinder unit II, serves to extend and retract telemember C; cylinder unit IV, which follows said cylinder unit III, serves to extend and retract telemember D, and the final unit V, which follows said cylinder unit IV, serves to extend and retract the outermost telemember E, i.e. the telemember which is extensible to the furthest degree.

Figure 1:
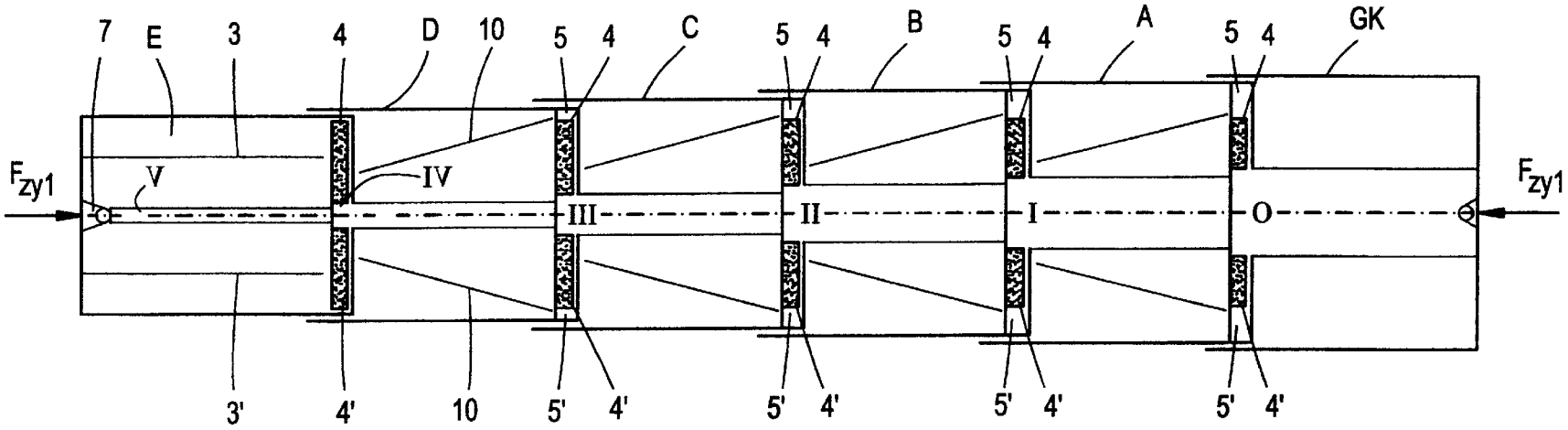
FIG. 1 is a schematic representation of a boom comprising five telemembers and a five-stage hydraulic cylinder, in the fully extended state.

As has only been outlined in FIG. 1, the upper end portions of cylinder units I to IV are connected to the upper end portions of two tie rods 10 whose lower ends are connected to the base areas of the respective telemembers A to D associated with said cylinder units in a motion-transmitting manner. Cylinder unit I is thus connected in a motion-transmitting manner to telemember A by means of such tie rods, cylinder unit II is connected in a motion-transmitting manner to telemember B by means of its tie rods, cylinder unit III is connected in a motion-transmitting manner to telemember C by means of its tie rods, and cylinder unit IV is connected in a motion-transmitting manner to telemember D by means of tie rods. Only cylinder unit V, which is extended furthest, is connected in a motion-transmitting manner to the upper telemember E without any tie rods being used. For this purpose, tie bolts (not shown) are provided, said tie bolts extending through holes 7, which are provided in the upper end portion of cylinder unit V, and being connected to telemember E in a motion-transmitting manner.

It is especially emphasized that said tie rods 10 may just as well be constructed as traction cables, or the like. It is only necessary that the motion of each telescopic hydraulic cylinder unit is transmitted to the associated telemember simultaneously and uniformly.

The diameters and the cross-sectional areas of the boom members decrease continuously from the basic member GK to the smallest telemember E, as can be seen from FIGS. 1 to 4. Also the diameters of the cylinder units decrease from the basic unit "O" to the furthest extensible and thinnest cylinder unit V.

Figure 6:
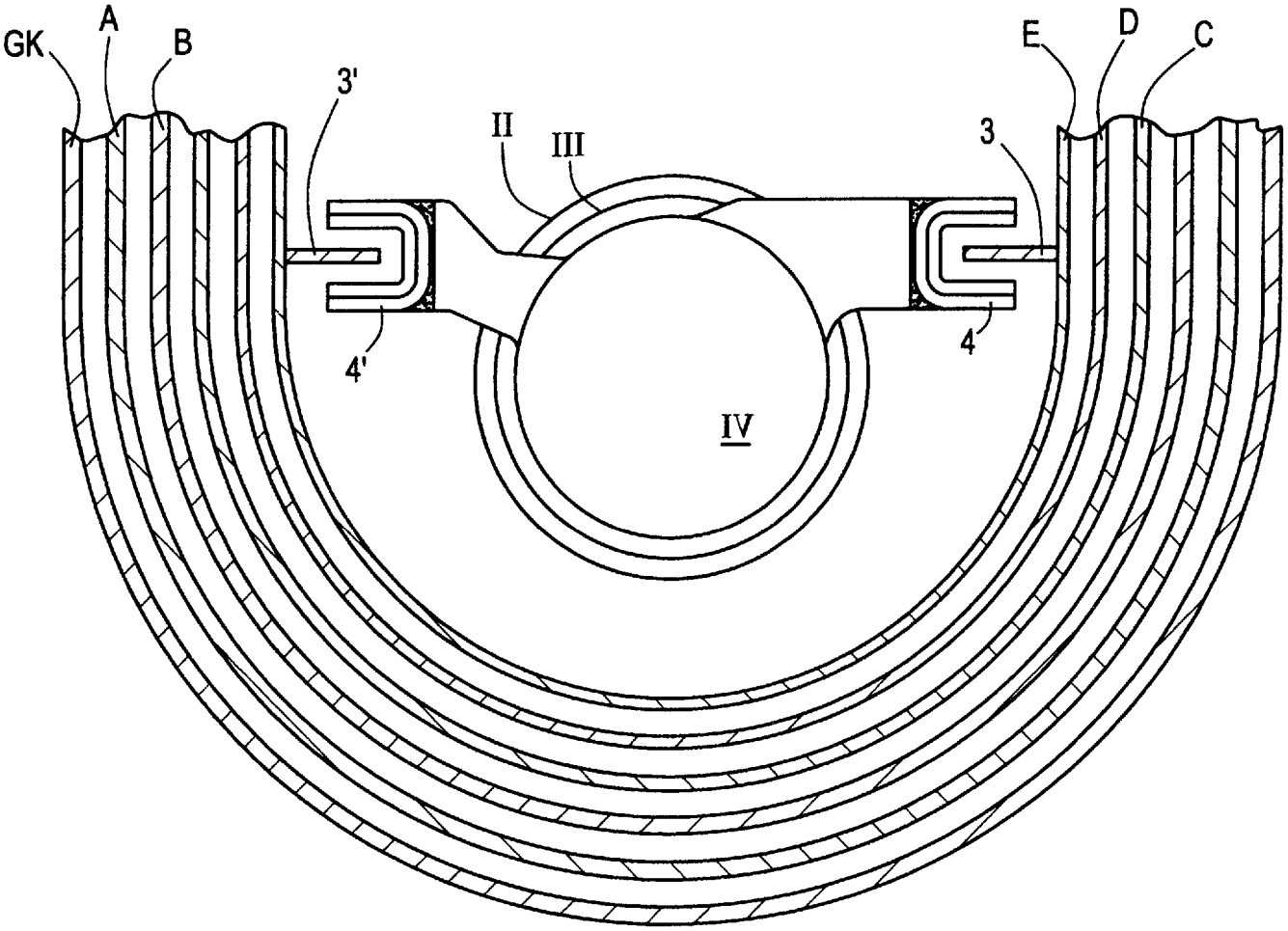
FIG. 6 is a representation of the way in which the components of the buckling protection device cooperate.

Telemember E, which is extensible to the furthest degree, has provided therein two opposite support rails 3, 3' extending along the inner wall thereof and parallel to the longitudinal axis of the hydraulic cylinder, said support rails 3, 3' having sufficiently solid dimensions and being welded to the inner wall of the telemember, as can be seen from FIGS. 1 and 6.

Supporting claws 4, 4', which are in engagement with said support rails 3, 3', are provided in the area of the upper end of cylinder unit IV, said supporting claws 4, 4' being arranged in opposed relationship with one another and welded to the outer wall of cylinder unit IV, as can be seen in FIG. 6. The thinnest cylinder unit V is not provided with any supporting claws and is not shown in FIG. 6.

The length of the support rails 3, 3' corresponds approximately to the length of the associated telemember E. From FIG. 4 as well as from the statements following hereinbelow, it will be evident that the length of the support rails 3, 3' should be dimensioned such that, in the retracted state (FIG. 4), all supporting claws 4, 4' are in engagement with the rails 3, 3'. As can be seen from FIGS. 1 to 4, telemembers A, B, C and D only have short support rail pieces 5, 5' instead of the long support rails 3, 3', said support rail pieces 5, 5' extending, however, in the same planes as the support rails 3, 3' of the outermost telemember E, i.e. in alignment therewith.

Also said short support rail pieces 5, 5' are fixedly connected to the inner walls of the associated telemembers A to D and they are preferably provided in the lower, i.e. in the base area of the above-mentioned telemembers. The long rail 3 is in alignment with the short rail pieces 5 in the extended state, just as the long rail 3' is in alignment with the short rail pieces 5' in the extended state. The rails 3, 3' and the short rail pieces 5, 5' preferably have beveled ends.

In the fully extended state of the boom according to FIG. 1, the two supporting claws 4, 4' of the basic unit "O" of the hydraulic cylinder are in engagement with the two short support rail pieces 5, 5' arranged in telemember A, whereas the supporting claws 4, 4' of cylinder unit I are in engagement with the short support rail pieces 5, 5' of telemember B. In the fully extended state, also the supporting claws 4, 4' provided on cylinder unit II are in engagement with the short support rail pieces 5, 5' of telemember C and the supporting claws 4, 4' provided on cylinder unit II are in engagement with the short support rail pieces 5, 5' provided in telemember D. As has already been described, the long support rails 3, 3" provided in telemember E, which is extended furthest, are permanently in engagement with the supporting claws 4, 4' provided on cylinder unit IV.

As can be seen from FIG. 6, the supporting claws 4, 4' enclose the support rails 3, 3' and the support rail pieces 5, 5', which are in alignment with these rails, from three sides, since each claw end has the shape of a C-section which is open towards the rails 3, 3' and towards the support rail pieces 5, 5'.

Due to the fact that the claws 4, 4' are in engagement with the rails 3, 3' and the short pieces 5, 5', respectively, the hydraulic cylinder can, as demonstrated in FIG. 6 where hydraulic cylinder unit IV is shown by way of example, only bend until one of the supporting claws 4, 4' comes into contact with one of the support rails 3, 3' or one of the support rail pieces 5, 5', either on the left- or on the right-hand side, at the top or at the bottom (FIG. 6). Horizontal or vertical buckling of the hydraulic cylinder is impossible because all cylinder units or at least one cylinder unit rest(s) on the associated telemembers by means of the claw and rail construction described hereinbefore, said telemembers having, in view of the loads to be hoisted, much more rigid dimensions from the very beginning.

The inside width between the opposing support rails 3, 3' of the outermost telemember E corresponds to the inside width between the opposing support rail pieces 5, 5' of telemembers A to D, as can be seen in FIGS. 1 to 4.

Figure 4:
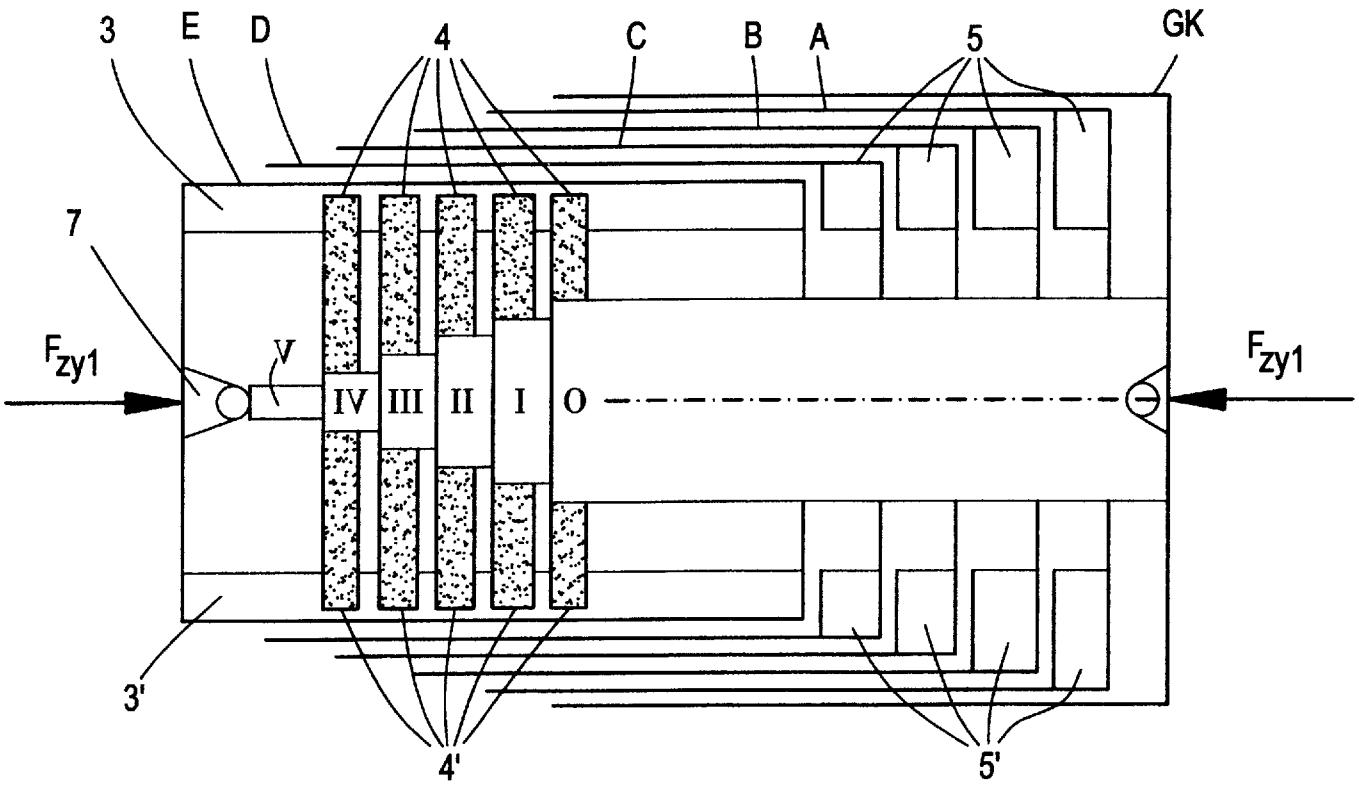
FIG. 4 shows the boom according to FIGS. 1 to 3 in the fully retracted state.

In the following, it will be described how the telemembers and the cylinder units are moved from their fully retracted starting position according to FIG. 4 via partly extended intermediate positions to their fully extended position according to FIG. 1:

In the starting position according to FIG. 4, all telemembers A to E are accommodated in the basic member GK of the boom according to their various sizes, and the cylinder units I to V are accommodated in the basic unit "O" of the cylinder according to their various sizes.

At this position, the telemember bases (bottom sides) through which the cylinder units extend face one another and are spaced apart essentially only in accordance with the dimensions of the support rail pieces 5, 5' in a direction parallel to the longitudinal axis of the hydraulic cylinder. The supporting claws 4, 4' of the cylinder basic member GK as well as of all cylinder units A to E are in engagement with the two support rails 3, 3' of the innermost telemember E at the starting position according to FIG. 4. In order to permit this engagement of all supporting claws with the rails 3, 3', said rails 3,3' must have clearly larger dimensions in the direction of the longitudinal axis of the cylinder, i.e. they must be longer than the short support rail pieces 5, 5'—a fact which has already been mentioned.

When cylinder unit I has applied thereto hydraulic pressure, said cylinder unit will move out of the basic unit "O". In view of the fact that, by means of the tie rods 10 (which are not shown) or with the aid of other suitable connection means, said cylinder unit I is fastened to telemember A—more exactly to the base side of said telemember A—the cylinder force Fzyl will be transmitted to telemember A so that this telemember will move upwards together with cylinder unit I simultaneously and uniformly therewith. As has already been mentioned, telemember A, however, still accommodates telemembers B to E at this time so that these telemembers B to E will move upwards together with telemember A, just as cylinder units I to IV which will take part in this movement. During the sequence of movements taking place between the condition according to FIG. 4 and the condition according to FIG. 3, the support rails 3, 3' of the innermost telemember E will move upwards, whereas the supporting claws 4, 4', which are associated with the basic unit "O" of the cylinder, will remain stationary. Hence, the rails 3, 3' of the innermost telemember E will be moved relative to the supporting claws 4, 4' of the basic member GK of the cylinder. In the course of this relative movement, the lower ends of the support rails 3, 3' will come out of engagement with the supporting claws 4, 4' associated with the basic unit "O" of the hydraulic cylinder. Subsequently, while the upward movement of cylinder unit I continues, these supporting claws of the basic unit "O" will come into and out of engagement first with the support rail pieces 5, 5' of telemember D, then with those of telemember C and subsequently with those of telemember B, said support rail pieces 5, 5' being in alignment with said support rails 3, 3'. When cylinder unit I has fully been extended (FIG. 3), the supporting claws 4, 4' of the basic unit "O" of the cylinder are in engagement with the support rail pieces 5, 5' of telemember A. In order to facilitate the above-described movement of the support rails or support rail pieces through the supporting claws, the end portions of said rails or rail pieces are beveled, as has already been described hereinbefore.

Figure 5:
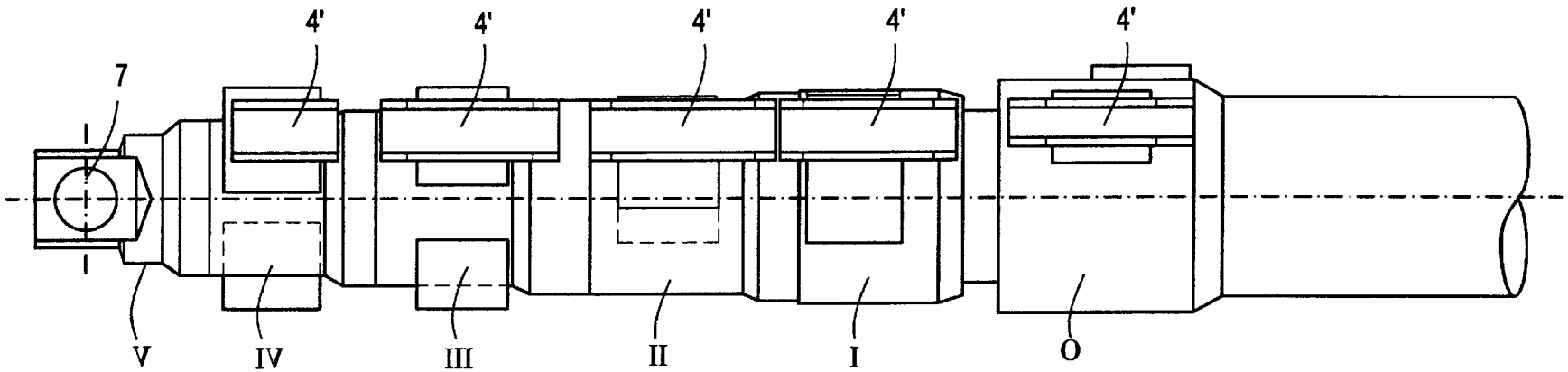
FIG. 5 shows a view of the hydraulic cylinder in the fully retracted state.

The length, i.e. the dimensions of the supporting claws 4, 4' parallel to the longitudinal axis of the cylinder, is chosen (cf. FIG. 5) such that spaces between neighboring ends of support rails and support rail pieces, respectively, are bridged so that "incorrect threading" cannot occur, i.e. so that any unintentional disengagement of a supporting claw from a support rail or a support rail piece is prevented.

It follows that the aimed-at protection against buckling of the hydraulic cylinder is guaranteed not only at the end position, e.g. according to FIG. 1, but also at all intermediate positions between the positions according to FIG. 1 up to the position according to FIG. 4 as well as during the extension movement.

Figure 2:
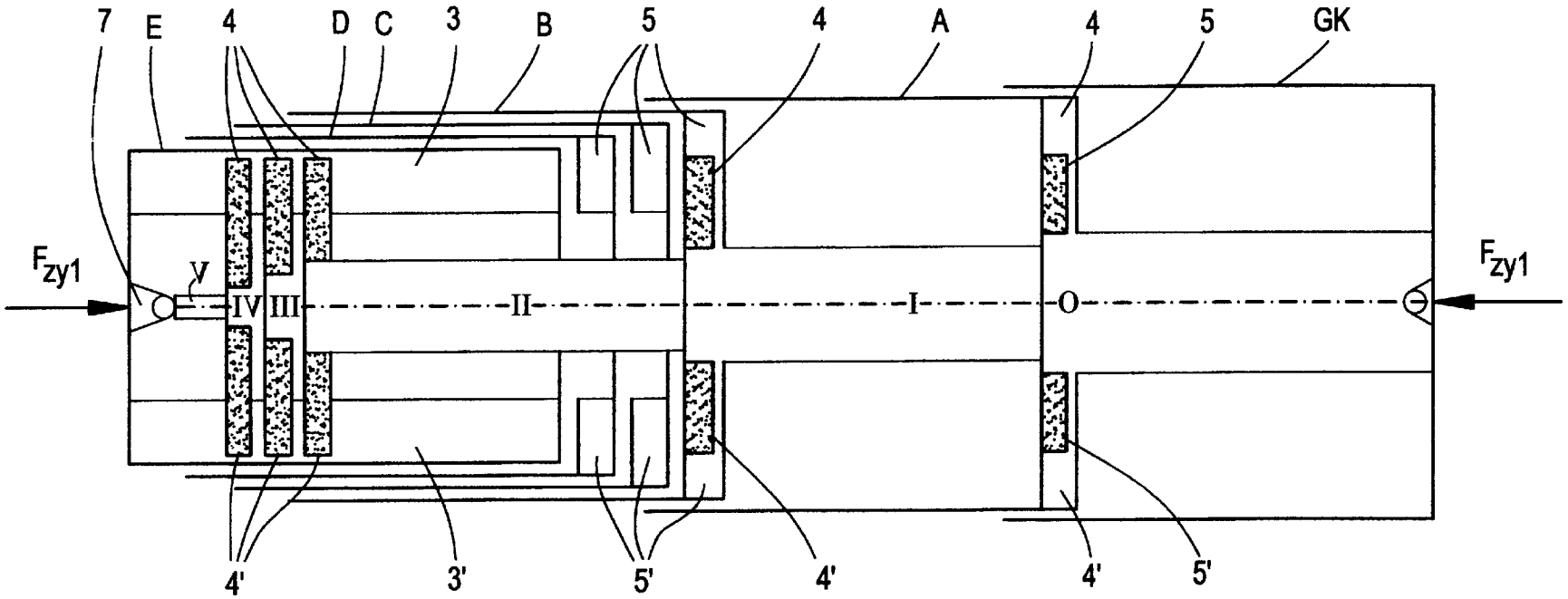
FIG. 2 shows the boom according to FIG. 1, in which, however, only two telemembers and only two units of the hydraulic cylinder are extended.
Figure 3:
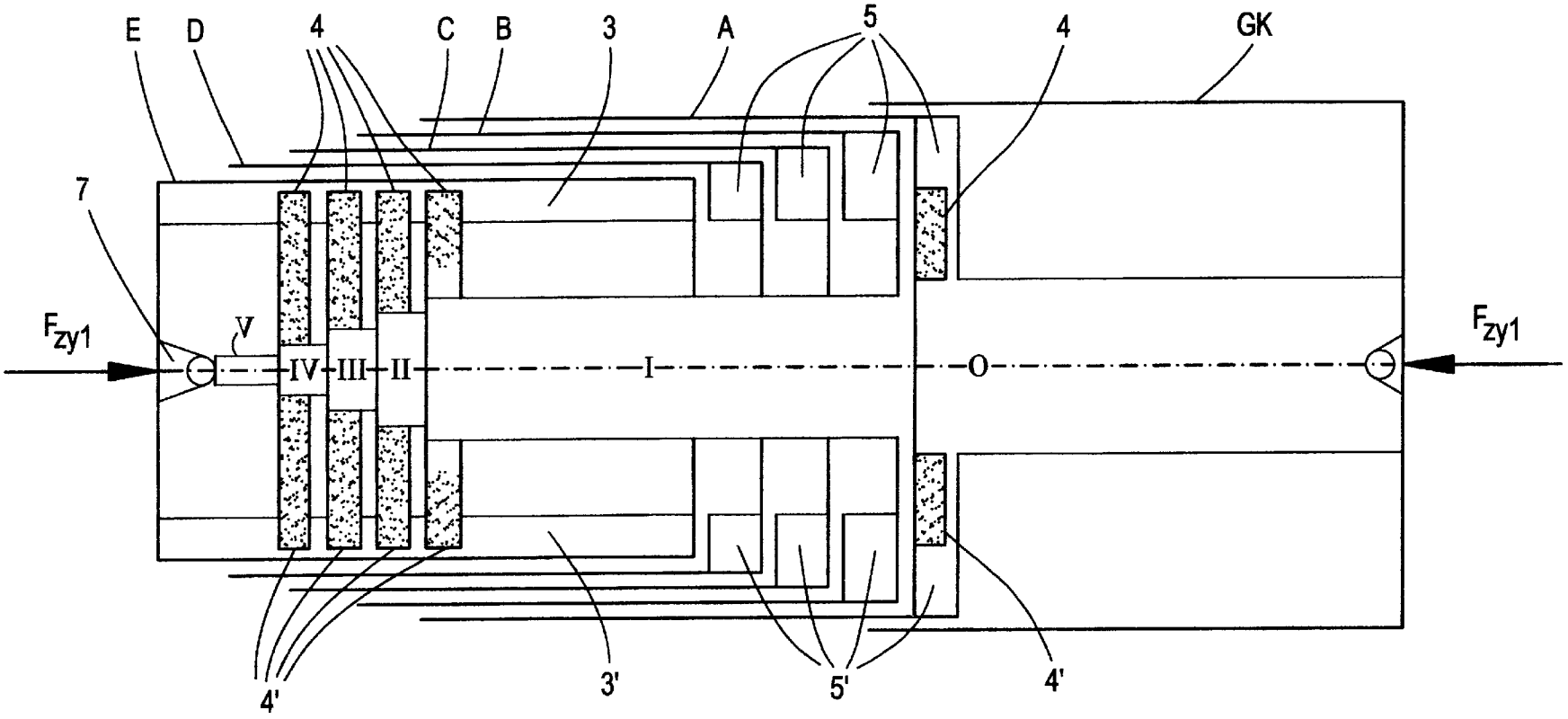
FIG. 3 shows the boom according to FIGS. 1 and 2, in which, however, only one telemember and only one unit of the hydraulic cylinder are extended.

In the next step, i.e. during extension of the boom from the position shown in FIG. 3 to the position according to FIG. 2, cylinder unit II is extended by means of pressure applied thereto. Also this unit is connected to the associated telemember B through tie rods 10 or the like, which are not shown. It follows that, due to the upward movement of telemember B as well as of telemembers C, D and E, which are accommodated in telemember B, a relative movement will again take place between the supporting claws 4, 4' associated with cylinder unit I and the support rails 3, 3' and the support rail pieces 5, 5' of telemembers D and C. When the cylinder stroke has been finished (cylinder II), the supporting claws 4, 4' associated with this unit II will be in engagement with the rail pieces 5, 5' of telemember B, as can be seen in FIG. 2.

Telemembers C, D and E will be extended in an analogous manner by a successive extension of cylinder units III, IV and V until the boom has reached a fully extended position according to FIG. 1. In this respect, attention has to be paid to the fact that the supporting claws 4, 4' of cylinder unit IV always remain in engagement with the support rails 3, 3' of the innermost telemember E at all extension positions from FIG. 4 to FIG. 1.

When the boom is retracted from the position according to FIG. 1 to the position according to FIG. 4, the above-mentioned steps are carried out in reverse order; cylinder unit V, which has the smallest diameter and which has telemember E fastened thereto, is retracted first, whereupon cylinder unit IV having telemember D associated therewith is retracted, and then, in succession, cylinder unit III with the associated telemember C, cylinder unit II with the associated telemember B and, finally, cylinder unit I with the associated telemember A.

It goes without saying that the gripping claws and the rails or rail pieces can be interchanged in accordance with the present invention; in this case, the individual cylinder units will have secured thereto rails or short rail pieces, whereas the inner walls of the telemembers will have secured thereto supporting claws which are in engagement with said rails or rail pieces so as to prevent buckling of the hydraulic cylinder.

As can especially be seen in FIGS. 1 to 4, the basic unit O of the multi-stage hydraulic cylinder is firmly connected at the bottom side to the associated basic member GK of the telescopic boom. At the head side, the outermost, i.e. the furthest extensible cylinder unit V and the associated outermost telemember E with the smallest diameter are connected to each other. The cylinder units I to IV are arranged thereinbetween with the telemembers A to D being assigned to said cylinder units. As is diagrammatically illustrated in FIG. 1, the upper ends of the hydraulic cylinder units I to IV are connected with the aid of tie rods 10 to the bottom portions of the associated telemembers A to D. The upper ends of the tie rods are connected by means of the associated supporting claws 4, 4' to the upper ends of the associated hydraulic cylinder units while the lower ends of the tie rods are connected in a longitudinally movable manner to the bottoms of the associated telemembers. As already mentioned, it is the task of tie rods 10 to carry along the associated telemember in the same direction and in a conforming manner when the cylinder units are extended hydraulically.

The embodiment of the tie rods as shown in FIG. 1 may have the effect in case of disorders in the normal sequence of the hydraulic extension or retraction of the telemembers of the boom that the rail pieces 5, 5' and the associated supporting claws 4, 4' do not get into engaging contact with each other in one or even a plurality of telemembers, which would lead to an undesired relative twisting of individual telemembers and cylinder units relative to one another and would, in particular, be detrimental to the buckling protection of the cylinder.

In the following text, there will therefore be described some kind of fastening or connection for tie rods 10 that will prevent the above-described danger and ensure that the tie rods and the cylinder units are permanently guided in vertical direction and horizontal direction, so that relative twisting of individual telemembers relative to one another and also of individual hydraulic cylinder units relative to one another is prevented, and also horizontal or vertical disalignment of rail pieces 5, 5' and supporting claws 4, 4'.

Figure 7:
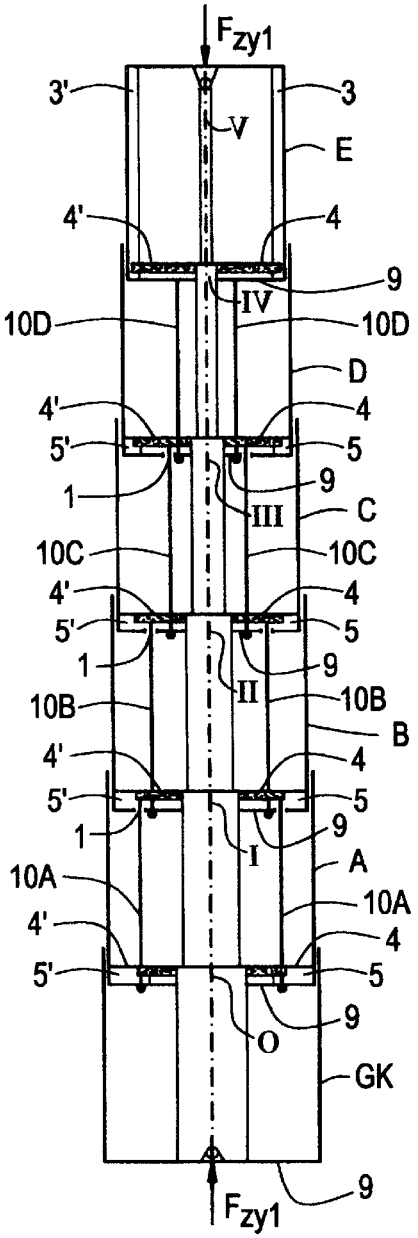
FIG. 7 is a representation substantially corresponding to FIG. 1, in which, however, the tie rods are tied in a preferred manner.
Figure 8:
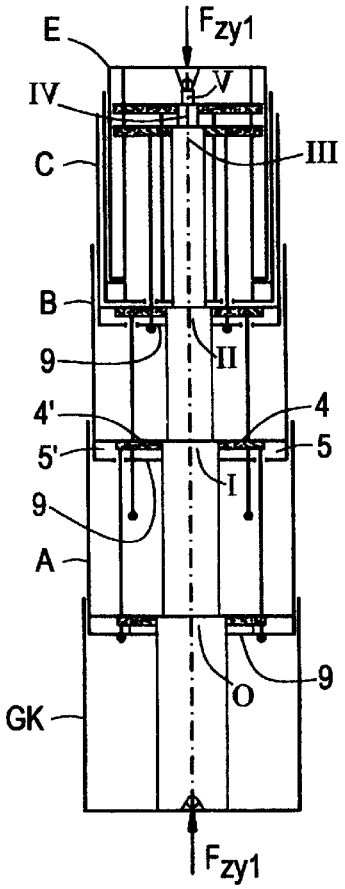
FIG. 8 shows the boom illustrated in FIG. 7 in the fully extended state, under an incorrect operative situation.
Figure 9:
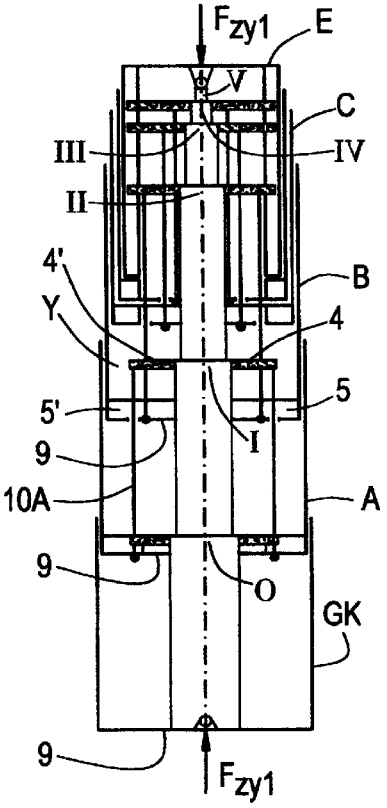
FIG. 9 shows the boom illustrated in FIG. 7 in another incorrect operative position.

This advantageous fastening of the tie rods, on the one hand, to the associated cylinder unit and, on the other hand, to the bottom of the associated telemember is illustrated and explained in FIGS. 7, 8, and 9. Attention should here be paid that FIGS. 7, 8, and 9 are illustrated on the same scale and are to be considered jointly. Special attention should be paid to the fact that all telemembers and all cylinder units have the same dimensions in FIGS. 7, 8, and 9. Whenever it seems that telemembers and/or cylinder units have smaller dimensions than shown in FIG. 7, this is a consequence of not fully extended operative states as compared with FIG. 7 which shows the boom with its basic body GK and its telemembers A, B, C, D and E with the associated hydraulic cylinder units O, I, II, III, IV and V in the fully extended state.

The reference numerals which are most needed for understanding the invention are just introduced into FIGS. 7 to 9. In FIGS. 8 and 9, reference numerals as are used in FIG. 7 have largely been dispensed with to ensure clarity of FIGS. 8 and 9.

In FIG. 7, the tie rods of telemember A, i.e. those tie rods which connect the upper end of the hydraulic cylinder unit I by means of supporting claws 4 and 4' to the bottom of telemember A are designated by reference numeral 10A. Likewise, the tie rods of telemember B which connect the upper end of the hydraulic cylinder unit II to the bottom of telemember B are designated by reference numeral 10B. A corresponding designation is chosen for tie rods 10C of telemember C and for tie rods 10D for telemember D.

As can be gathered from FIGS. 7 to 9, tie rods 10A of telemember A are secured with their upper ends to supporting claws 4, 4' of cylinder unit I. Openings 1 which respective tie rods 10A pass through are formed in bottom 9 of telemember B and also in bottoms 9 of telemembers C and D. The lower ends of tie rods 10A are secured in bottom 9 of telemember A, as diagrammatically shown in FIGS. 7 to 9. The lower tie rod ends are preferably secured with the aid of nuts embedded in bottom 9 or with the aid of fastening means assigned to the bottom. Tie rods 10B of telemember B are secured accordingly with their upper ends to the supporting claws 4, 4' of the hydraulic cylinder unit II assigned to telemember B. Starting from this fastening of the upper ends of tie rods B, these tie rods pass through bottom openings 1 which are provided in the bottom of telemember C. The lower ends of tie rods 10B are connected to the bottom 9 of telemember B. The tie rods 10C of telemember C are correspondingly fastened with their upper ends to the supporting claws 4, 4' of the hydraulic cylinder unit III assigned to telemember C, and the lower ends of the tie rods 10C are secured in bottom 9 of telemember C. The tie rods 10C pass through bottom openings 1 in the bottom of telemember D. Likewise, tie rods 10D of telemember D are secured with their upper ends in the supporting claws 4, 4' of the hydraulic cylinder unit IV, and the lower ends of these tie rods 10D are connected in bottom 9 of telemember D. The tie rods 10D pass through bottom 9 of the outermost telemember E.

For instance, in case the cylinder unit III which is connected with telemember C extends prior to the cylinder unit II reaching its full telescopic length with the associated telemember B, bottom openings 1 of the extending telemember C will slide due to the above-described construction along the tie rods 10B which are assigned to telemember B and the hydraulic cylinder unit II. In case of maximum lifting of unit III the openings 1 in bottom 9 of telemember C will come to a halt before the tie rod connection at cylinder unit II.

The above-described mechanism of action is applicable to all cylinder units and the associated telemembers, except for the outermost telemember E and the cylinder unit V thereof, since, as already described, the cylinder unit V is not connected by means of tie rods to the bottom portion of telemember E, and since the guide claws of cylinder unit IV will never leave the guide rails 3, 3' of telemember E.

It is ensured thanks to the above-described fastening of the tie rods that all tie rods are permanently guided with the aid of bottom openings 1, i.e., in vertical direction and horizontal direction. Hence, all cylinder units are permanently guided with their guide claws at the same time.

As follows in a general manner from the above-described fastening, the individual cylinder units and the associated telemembers cannot rotate or twist relative to one another.

Furthermore, the following advantages, which will be explained with reference to FIGS. 8 and 9 and improve the technical operational reliability follow from the above-described fastening of the tie rods.

It should once again be noted that FIGS. 8 and 9 illustrate the telemembers and also the hydraulic cylinder units, and the like, on the same scale as shown in FIG. 7. In comparison with FIGS. 7 to 9, it should be noted with respect to the engagement of the supporting claws 4, 4' of the basic member 0 of the hydraulic cylinder with the rails 5, 5' in the bottom portion of the telemember A that said engagement takes place in all of the three above-mentioned figures in the same height plane. As for the engagement of the guide claws 4, 4' of the cylinder unit I in the rail pieces 5, 5' of telemember B, the situation in FIGS. 7 and 8 is the same; in FIG. 9 it is only the supporting claws 4, 4' of the cylinder unit I that are at the same height as in the illustrations acording to FIGS. 7 and 8 whereas in FIG. 9 said supporting claws 4, 4' are not in engagement with the rail pieces 5, 5' of telemember B.

It should be noted that in FIG. 7 the illustrated boom has been fully extended while in FIGS. 8 and 9 the same boom is shown in different extending or retracting situations.

FIG. 8 illustrates a situation in which for reasons of disorder the cylinder unit II already retracts (into cylinder unit I) despite the fact that cylinder unit II has not been extended completely or partly yet. Just to be correct, the extension takes place in the order of cylinder units I to V whereas retraction correctly takes place in the order of cylinder units V to I. As can be seen in FIG. 8, the wrongly retracting cylinder unit II cannot project beyond the rear edge of the telemember supporting the same, with the supporting claws 4, 4' of cylinder unit II being in engagement with rail pieces 5, 5'. However, the erroneously retracting unit II drags along the telemember C supporting the same via the permanent guidance of the tie rods, as illustrated with reference to FIG. 7, and their fastening to the corresponding telemember. When the cylinder unit II is subsequently retracted, the telemember B is moved in synchronism therewith (bottom 9 of telemember C rests on bottom 9 of telemember B, thereby exerting a force on telemember B). Claws 4, 4' of cylinder unit I will therefore loose their supporting rail pieces 5, 5' of telemember B and slide over to rail pieces 5, 5' of telemember C. These rail pieces were previously centered as to height and alignment via tie rods 10B when telemember C was approaching telemember B. As a consequence of the fastening process according to the invention, and despite the remaining incorrect sequence of retraction of the cylinder units, the supporting effect against buckling has been fully maintained.

The above-mentioned centering will be explained in the following by way of example with reference to tie rods 10B.

Tie rods 10 B lead through bottom opening 1 of telemember C, but do not slide relative thereto. By contrast, tie rods 10 B are pushed rearwards out of their fastening means, such as eyes in the bottom of telemember B. These fastening means and the bottom opening are at one height and in alignment, centering the telemembers B and C via the tie rods 10 B extending through both members when the telemembers approach one another. Hence, the rail pieces 5, 5' of telemember B and the rail pieces 5, 5' of telemember C are simultaneously aligned relative to one another.

Rail pieces 5, 5' of all other telemembers C are centered and aligned relative to one another accordingly, except for telemember E.

FIG. 9 illustrates a situation in which cylinder unit III is extended because of some errors or other before the cylinder unit II has been fully extended. This moving apart of the cylinder units II and III in the wrong order creates a gap between rail pieces 5, 5' which have been designated in FIG. 9 by reference numeral Y. The supporting claws 4, 4' of cylinder unit I are in this gap out of engagement with the supporting rail pieces 5, 5' of telemember B, whereas such an engagement exists in the situation illustrated in FIG. 8.

The above-mentioned gap Y between the individual guide rails follows from the fact that the telemembers C, D and E have moved away from the remaining telemembers with their rail pieces 5, 5' provided at the bottom side. This gap Y, which exists under the exemplary situation according to FIG. 9 between telemembers A and B cannot be bridged by the supporting claws 4, 4' assigned to the cylinder step I, which has the effect that the desired buckling protection is jeopardized and an undesired twisting of individual telemembers relative to one another is made possible.

It is ensured by means of the tie rods 10A which are connected with their upper ends to the cylinder unit I and with their lower ends to the bottom of telemember A, that the supporting claws 4, 4' remain aligned relative to the rail pieces 5, 5' of telemember B because a relative twisting of the rail pieces and of the cylinder unit II cannot occur. If during the further extension of cylinder unit II from the situation shown in FIG. 9 the supporting claws and the rail pieces enter again the height positions assigned to one another, the desired engagement between the supporting claws and the rail pieces can easily be established as a consequence of the constantly kept alignment of these members relative to one another.

I claim:

1. A telescopic boom, comprising:

a plurality of telescopic boom members, said boom members having hollow interiors for telescopically receiving said boom members inside one another;

a multistage hydraulic cylinder including a plurality of cylinder units for extending and retracting the boom members, said multistage hydraulic cylinders being located within the hollow interiors of said plurality of telescopic boom members;

a plurality of the cylinder units each having secured thereto a first component of a supporting device;

a plurality of the boom members each having secured thereto a second component of said supporting device which cooperates with the first component of said supporting device to support the hydraulic cylinder on the boom members;

wherein one of said first and second components of said supporting device includes two opposing claw members and the other of said first and second components of said supporting device includes two opposing rail members locatable within the claw members, the second components being disposed on inner walls within the interiors of said plurality of boom members;

wherein the opposing second components of an innermost of said boom members have a sufficient longitudinal length along the innermost boom member that in a retracted state all of the first components are in engagement with the opposing second components of the innermost boom member, and wherein the opposing second components of subsequent ones of said boom members are short second component pieces having a sufficient longitudinal length at the lower base area of the subsequent boom members to engage at least one of the first components and which are in alignment with said innermost boom second components, and wherein said plurality of boom members have bottoms that are spaced apart when in a retracted state essentially only a distance corresponding to the lengths of the short second component pieces, and wherein said first components are dimensioned to bridge between neighboring ends of adjacent second components to prevent unintentional disengagement of said first components with said second components.

2. A telescopic boom according to claim 1, wherein said innermost one of the boom members has the smallest diameter of the boom members and includes opposing rail members extending along an inner wall thereof as the second components of said innermost boom member.

3. A telescopic boom according to claim 2, wherein the plurality of boom members include the boom member having the smallest diameter, a boom member having the largest diameter, and a plurality of intermediate boom members located therebetween, and wherein said boom member having the largest diameter and the plurality of intermediate boom members include opposing short rail members provided in a base section of an inner wall thereof and having a length substantially shorter than a height of said inner wall as said second components thereof.

4. A telescopic boom according to claim 3, wherein the rail members and short rail members are arranged in the same plane in a longitudinal direction, and are in alignment with each other and parallel to an axis of the hydraulic cylinder.

5. A telescopic boom according to claim 4, wherein each of the plurality of cylinder units is mechanically connected to one of the telescopic boom members for moving each of the telescopic boom members simultaneously and uniformly with the aid of an associated cylinder unit.

6. A telescopic boom according to claim 5, wherein tie rods are provided as mechanical connection members, the tie rods connecting a front end section of each cylinder unit to a base side area of an associated boom member.

7. A telescopic boom according to claim 6, wherein the front end section of the cylinder unit associated with the smallest diameter boom member is connected to a front end section of said boom member.

8. A telescopic boom according to claim 7, wherein the tie rods have upper ends secured to the claw members of each cylinder unit and lower ends which are longitudinally displaceable in bottoms of the associated boom members, and wherein passage openings are provided for the tie rods in the bottom of an adjacent larger diameter boom member.

9. A telescopic boom according to claim 8, wherein the tie rods extend substantially parallel to said cylinder units and wherein a lower end of said tie rods includes a widened portion preventing said tie rods from being pulled through said passage openings, such that said tie rods can move down into said passage openings without being removed therefrom, said tie rods and said passage openings being constructed such that the rail members are maintained in alignment even in the event that the rail members and the claw members are disengaged.

10. A telescopic boom according to claim 3, wherein a width between inside edges of the opposing rail members and a width between inside edges of the opposing short rail members are the same for all of the boom members.

11. A telescopic boom according to claim 2, wherein in a fully retracted condition of the boom, the opposing claw members are in engagement with the opposing rail members of the smallest diameter boom member.

12. A telescopic boom, comprising:

a plurality of telescopic boom members, said boom members having hollow interiors for telescopically receiving said boom members inside one another;

a multistage hydraulic cylinder including a plurality of cylinder units for extending and retracting the boom members, said multistage hydraulic cylinders being located within the hollow interiors of said plurality of telescopic boom members;

a plurality of the cylinder units each having secured thereto a first component of a supporting device;

a plurality of the boom members each having secured thereto a second component of said supporting device which cooperates with the first component of said supporting device to support the hydraulic cylinder on the boom members;

one of said first and second components of said supporting device includes two opposing claw members and the other of said first and second components of said supporting device includes two opposing rail members locatable within the claw members, the second components being disposed on inner walls within the interiors of said plurality of boom members;

wherein said innermost one of the boom members has the smallest diameter of the boom members and includes opposing rail members extending along an inner wall thereof as the second components of said innermost boom member;

wherein the plurality of boom members include the boom member having the smallest diameter, a boom member having the largest diameter, and a plurality of intermediate boom members located therebetween, and wherein said boom member having the largest diameter and the plurality of intermediate boom members include opposing short rail members provided in a base section of an inner wall thereof and having a length substantially shorter than a height of said inner wall as said second components thereof;

wherein the rail members and short rail members are arranged in the same plane in a longitudinal direction, and are in alignment with each other and parallel to an axis of the hydraulic cylinder;

wherein each of the plurality of cylinder units is mechanically connected to one of the telescopic boom members for moving each of the telescopic boom members simultaneously and uniformly with the aid of an associated cylinder unit;

wherein tie rods are provided as mechanical connection members, the tie rods connecting a front end section of each cylinder unit to a base side area of an associated boom member;

wherein the front end section of the cylinder unit associated with the smallest diameter boom member is connected to a front end section of said boom member;

wherein the tie rods have upper ends secured to the claw members of each cylinder unit and lower ends which are longitudinally displaceable in bottoms of the associated boom members, and wherein passage openings are provided for the tie rods in the bottom of an adjacent larger diameter boom member.

* * * * *